US006345618B1

(12) United States Patent
Hayek

(10) Patent No.: US 6,345,618 B1
(45) Date of Patent: Feb. 12, 2002

(54) CUIRASS VENTILATOR AND SEAL THEREFOR

(76) Inventor: Zamir Hayek, 10 Downage, Hendon, London, NW4 1AA (GB)

( * ) Notice: Subject to any disclaimer, the term of this patent is extended or adjusted under 35 U.S.C. 154(b) by 0 days.

(21) Appl. No.: 09/230,025

(22) PCT Filed: Jul. 16, 1997

(86) PCT No.: PCT/GB97/01927

§ 371 Date: Mar. 3, 1999

§ 102(e) Date: Mar. 3, 1999

(87) PCT Pub. No.: WO98/03145

PCT Pub. Date: Jan. 29, 1998

(30) Foreign Application Priority Data

Jul. 18, 1996 (GB) ..... 9615092

(51) Int. Cl.[7] ..... A61G 10/00

(52) U.S. Cl. ..... 128/202.12; 128/204.18; 128/205.17; 128/205.26

(58) Field of Search ..... 128/202.12, 204.18, 128/206.23, 206.24, 206.25, 201.24, 200.24, 205.13, 205.17

(56) References Cited

U.S. PATENT DOCUMENTS 3,890,967 A * 6/1975 Elam et al. ..... 128/205.17
4,095,590 A * 6/1978 Harrigan ..... 601/1
4,342,278 A * 8/1982 Horan ..... 114/345
4,815,452 A 3/1989 Hayek ..... 128/302
4,930,498 A 6/1990 Hayek ..... 128/30.2
5,074,297 A * 12/1991 Venegas ..... 128/204.18
5,107,547 A * 4/1992 Scheu ..... 128/206.19
5,165,395 A * 11/1992 Ricci ..... 128/202.22
5,249,968 A * 10/1993 Brault et al. ..... 434/265
5,573,498 A 11/1996 Hayek ..... 601/41

* cited by examiner

*Primary Examiner*—John G. Weiss
*Assistant Examiner*—V. Srivastava
(74) *Attorney, Agent, or Firm*—Allston L. Jones

(57) ABSTRACT

A cuirass type ventilator compresses a shell member having a peripheral edge and a sealing device secured to the peripheral edge, the sealing device compressing a scaling member depending from the peripheral edge of the shell, the sealing member having a sealing region for sealing against a patient's body, a securing region whereat the sealing member is secured to the shell and a resilient pleated region intermediate the sealing region and securing region whereby, in use, the resilience of the pleated region urges the sealing region into scaling engagement with a patient's body.

10 Claims, 6 Drawing Sheets

CUIRASS VENTILATOR AND SEAL THEREFOR

The present invention relates to ventilator apparatus, and more particularly but not exclusively to so-called "cuirass ventilators".

Where a patient requires assistance in breathing, it is often preferable to use a ventilator apparatus external to the body rather than using intubation of the patient. Known ventilator apparatus includes the "iron lung" type in which the torso of the patient is fully enclosed within the iron lung, and the cuirass ventilator which consists generally of a turtle shell-like enclosure which is applied to the front of the trunk of the patient and, when associated with an air oscillator, which provides breathing assistance.

The peripheral edge region of the shell of the cuirass ventilator requires to be substantially sealed to the skin of the patient both during the inhalation and expiration phases. One solution to provision of the requisite seal has been to make a shell which is tailored to the individual patient. However, this is expensive and time-consuming. Another technique has been to provide a large number of different standard sizes of shell, each provided for example with a foam-type sealing means about the periphery, and to form the shell of the material which, while being sufficiently rigid to allow the correct breathing action, is sufficiently flexible that the periphery will conform to the contours of the patient in question. Other arrangements include those disclosed in GB Application No 8900871. Yet another ventilator is disclosed in GB Application No 8618254. This latter document discloses a ventilator apparatus comprising a shell with a sealing member between the shell and the patients body, the sealing member having the form of a pleated flexible curtain which is capable of being drawn sealingly against the patients body by straps.

The present applicant has carried out research in the field of ventilator apparatus and has a number of patent applications including EP-A-506467, EP-A-0379049, EP-A-0258302, EP-A-0373153 and EP-A-0192337.

A number of problems exist with prior solutions, for example a relative large number of different sizes of shell are required. Furthermore, the resilience of the shell which is typically applied to the patient by straps around the patient's back, may cause discomfort to the patient. The selection of materials to provide the desired degree of resilience is difficult and the resilient performance of the shell may degrade over a period of use.

From the point of view of the patient and of medical staff attending the patient, prior ventilators may cause chafing or ulceration at certain points, for example, in the arm pit region of the patent, at the transition between a portion of the ventilator shell which runs across the chest to a portion of the ventilator shell which runs along the side of the chest, down the patients body. The consequence of this may be a frequent need to attend to the patient by medical staff to prevent such chafing from causing ulceration.

Where a sealing flap has been provided in the prior art, it has been found difficult to provide adequate performance in the transition region of the seal between the region across the patients chest and the region running down the patients trunk, which transition region typically lies near to the arm pit of the patient. In the region of the sealing flap which runs across the patients chest, the sealing flap is required to seal in a generally downwardly, with respect to a surface on which the patient is lying, direction whereas in the sealing region which runs along the patients trunk, the sealing pressure is exerted generally transverse to such a surface, in other words in a perpendicular direction to that for the seal across the patients chest. The above-mentioned transition region therefore runs between these two regions and across the transition region the direction of sealing pressure varies. This feature, together with the varying geometry of the body associated with this transition region frequently leads to the sealing flap tearing, in use, and, even if tearing does not occur, the pressure in the area around the arm pit can cause discomfort to the patient which may lead to skin ulcers or pressure sores if the patients position is not moved fairly frequently, for example more than every four hours.

It would be desirable to provide an improved sealing device which provides a greater degree of conformability to the contours of a patient. Such a sealing device would enable a smaller number of standard sizes of shells to be stocked and would substantially reduce patient discomfort. As the conformability of the ventilator could be provided by the sealing device rather than by the material of the ventilator shell itself, the choice of material for the shell is not restrictive as in prior art devices.

It would also be desirable to provide a cuirass ventilator in which the above-mentioned propensity to chafing is at least reduced, or is eliminated. With such a ventilator apparatus, the Unsealing engagement pressure in the armpit region of the patient would be reduced, thereby reducing discomfort and eliminating any tearing of the seal while at the same time maintaining the ventilator air pressure.

It would also be desirable to provide a sealing device which requires a lower seal engagement pressure in the above-mentioned transition region while being capable of, in use, maintaining the required pressure conditions within the ventilator. Such a seal further reduces discomfort to the patient and eliminates the tendency of tearing of the seal.

According to the present invention, there is provided a cuirass ventilator comprising a shell member having a peripheral edge and a sealing device secured to the peripheral edge, the sealing device comprising a sealing member depending from the peripheral edge of the shell, the sealing member having a sealing region for sealing against a patient's body, a body portion having a securing region whereat the sealing member is secured to the shell and a resilient pleated region intermediate the sealing region and securing region whereby, in use, the resilience of the pleated region urges the sealing region into sealing engagement with a patient's body.

Preferably, the pleated region comprises a plurality of pleat portions connected serially at fold regions, a first end pleat portion being contiguous with said body portion at a first end fold region, and a second end pleat portion, opposite said first end portion being contiguous with said sealing region at a second end fold line.

Conveniently the peripheral edge of the shell has a first portion which, in use, is disposed in proximity with the top of a patient's chest, second and third portions which extend substantially parallel to the patients height and a fourth portion which extends across the abdomen of the patient and the sealing member is so secured to the shell member as to be inwardly directed in the second and third portions and to be downwardly directed towards the chest or respectively abdomen in the first and fourth portions.

Preferably respective transition portions extend contiguously between the first and second, and first and third portions, the transition portions, in use, being disposed in the armpit region of the patient.

Preferably in said transition portions, the sealing member is shaped for resilient conformability with the body of a patient.

Conveniently, said plurality of pleat portions comprises at least two portions.

Advantageously, said plurality of pleat portions comprises four portions.

Advantageously, the shell is provided with a peripheral flange region and the securing region of the sealing device has a counterpart slot for receiving therein the flange region.

Advantageously, the flange region includes a securing lip for retaining the sealing device thereof.

An embodiment of the invention will now be described with respect to the accompanying drawings in which:

According to a second aspect of the present invention there is provided a ventilator sealing device comprising a body portion for securing the sealing device to a peripheral edge of a cuirass ventilator, a sealing region for sealing against a patients body and a resilient pleated region intermediate the body portion and the sealing region.

Advantageously the pleated region comprises a plurality of seal portions connected serially at fold regions, a first end portion of said pleated region being contiguous with said body portion at a first end fold region, and a second end portion, opposite said first end portion being contiguous with said sealing region at a second end fold line.

Preferably the sealing device forms a ring.

According to a third aspect of the present invention there is provided a cuirass ventilator shell having a peripheral edge which is concavo-convex in cross-section, the edge having a hook securing means for a sealing device in accordance with the second aspect of the present invention.

In the Figure like reference numerals refer to like parts.

Figure 1:
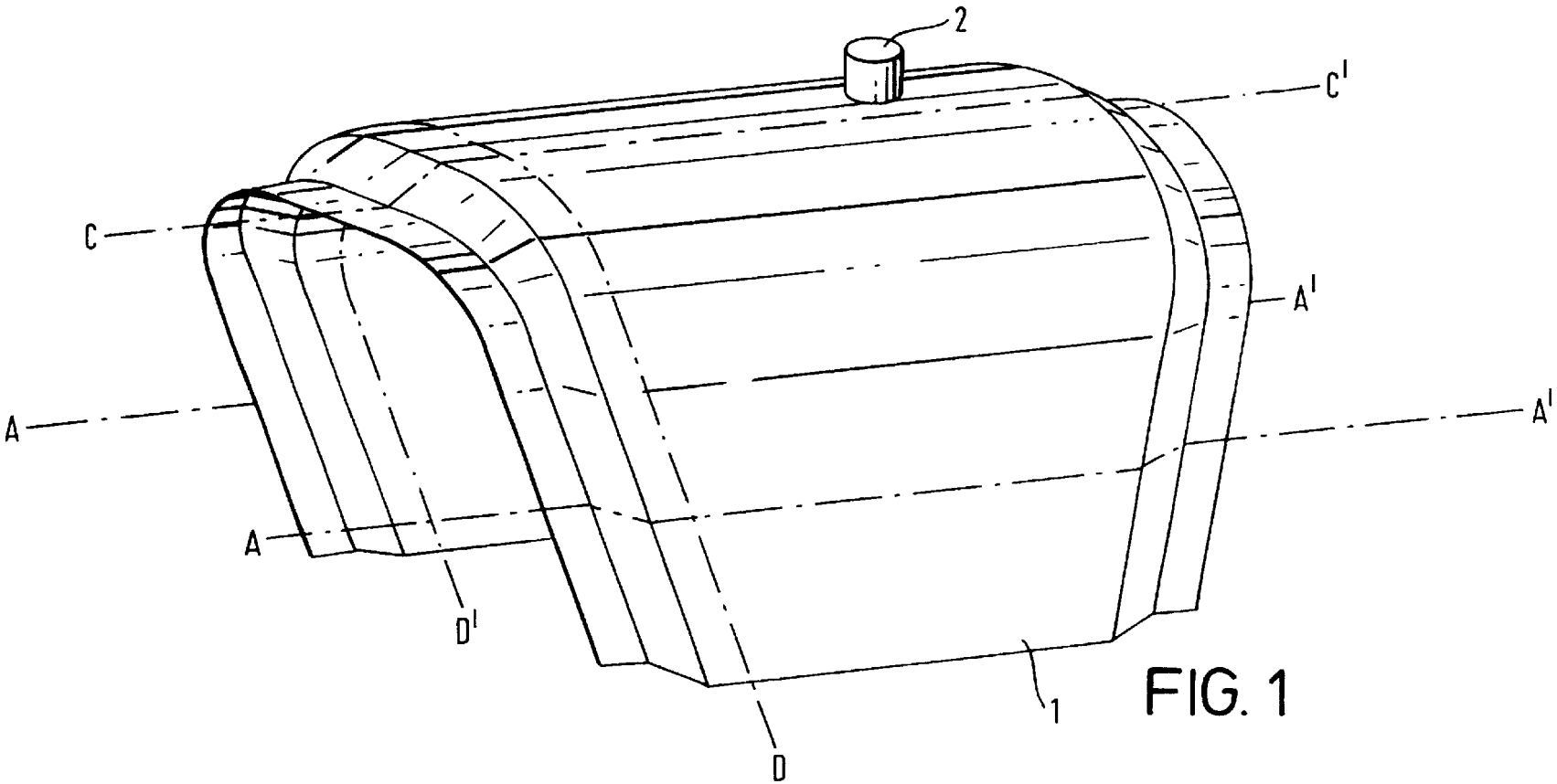
FIG. 1 shows a perspective view of a ventilator shell for application to a patient.

Starting with FIG. 1, a cuirass ventilator comprises a shell 1 adapted to cover the chest and abdomen of a patient. The shell has a port for attachment to an air oscillator, as is well-known in the art, for providing suitable pressure for assisting breathing which may be alternate positive and negative, or positive or negative. All around the peripheral edge of the shell 1 there is provided a sealing member which will now be described with respect to FIG. 2.

Figure 2:
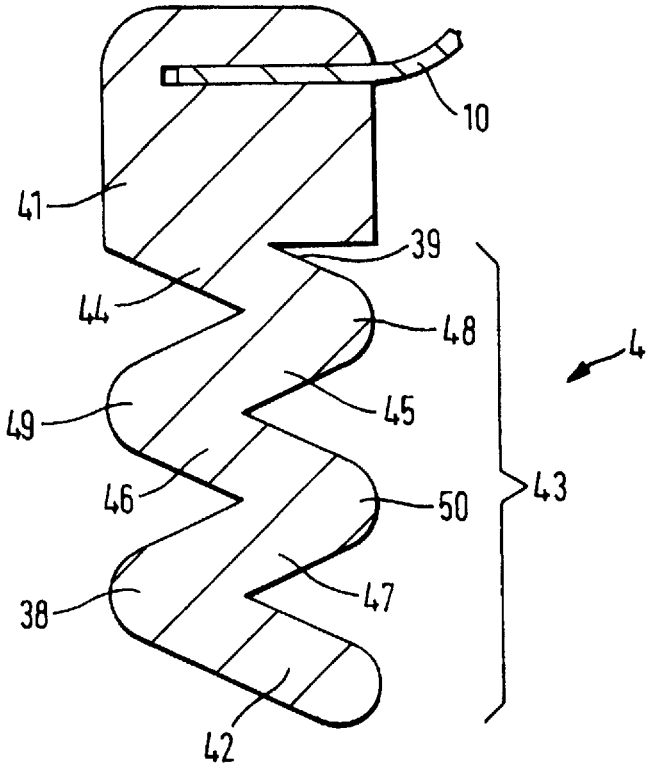
FIG. 2 shows a detailed view of a first embodiment the sealing device in cross-section when fitted to a shell.

Referring to FIG. 2, the shell 1 is provided with a flange region 10 which extends about its peripheral edge. The sealing device 4 is resilient and has a body portion 41 at one end thereof, the body being of rectangular cross-section. The body 41 has a slot adapted to engage the flange region 10 whereby the walls of the slot form a securing region so that, in use, the body portion extends around the peripheral edge of the ventilator shell. The resilience of the sealing device 4 causes the opposing walls of the slot to grip the flange portion 6f the shell. The sealing device 4 further has a sealing region 42 which in the embodiment of FIG. 2 forms the other end of the sealing device 4. Intermediate the body portion (41) and the sealing region (42) is a pleated region 43 which comprises first-fourth pleat portions 44–47 which are contiguous with one another and are connected at respective folds 48–50. The first pleat portion 44 is connected to the body 41 at a fold 39 so that in use the sealing device 4 depends from the peripheral edge of the shell 1 and so that the first pleat portion 44 extends generally inwardly of the shell 1. The fourth pleat portion 47 is connected to the sealing region 42 at a second end fold 38 such that the sealing region 42 also extends generally inwardly of the shell 1. The sealing region 42 is advantageously similar in dimension to the portions 44–47 of the pleated region although it would of course be possible to make the sealing region thicker, thinner, wider or narrower if so required.

The resilience of the sealing device 4 causes force exerted on the sealing region 42 will tend to be transmitted to the securing region 41, and vice versa. In the present embodiment, the material of the sealing device is a closed-cell from material such as plastics or rubber which is moulded in the form shown.

Figure 3:
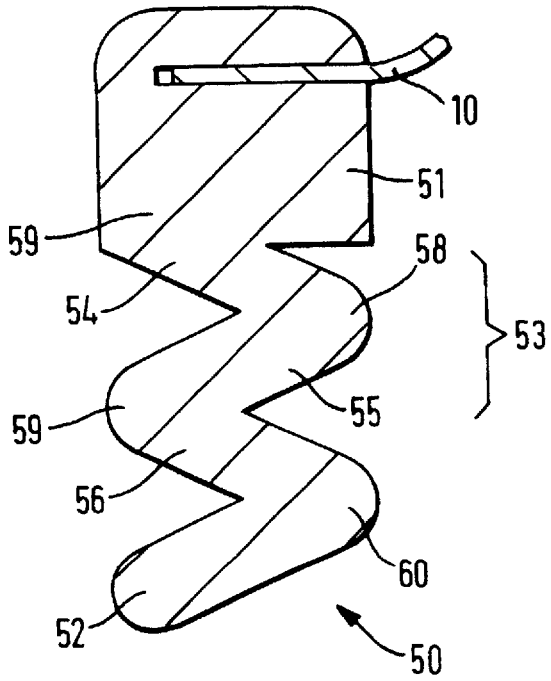
FIG. 3 shows a detailed view of a second embodiment the sealing device in cross-section when fitted to a shell.

FIG. 3 shows a second embodiment 50 of the sealing device. In this second embodiment, a body portion 51, similar to the body portion 41 of the first embodiment, engages on the flange region 10 of the shell. A sealing region 52, once again forms an end of the sealing device 50. Intermediate the body portion 51 and the sealing region 52 is a pleated region 53 comprising first-third pleat portion 54–56 which are contiguous with one another and are connected at respective folds 58 and 59. The first pleat portion 54 is connected to the body portion 51 at a fold 59 such that the sealing device 50 depends from the peripheral flange region of the shell and such that the first pleat portion 54 extends generally inwardly of the shell. The third pleat portion 56 is connected to the sealing region 52 at a second end fold 60 such that the sealing region 52 extends generally outwardly of the shell 1.

Figure 4:
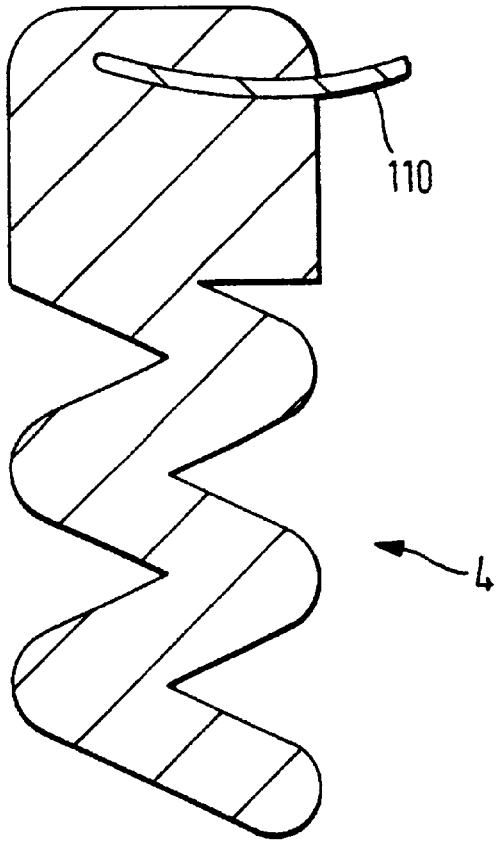
FIG. 4 shows a view similar to that of FIG. 2, in which the shell has a concavo-convex section flange.

Turning to FIG. 4, an advantageous embodiment of the shell has a peripheral flange region 110 which is concavo-convex in section. As shown, the concave portion of the section is directed away from the patient so as to tend to retain the sealing device 4 more securely on the flange region.

Figure 5:
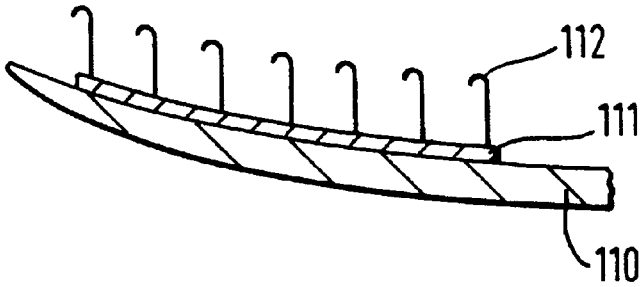
FIG. 5 shows a cross-section through the flange of FIG. 4 and shows a hook fastener device secured thereto.
Figure 6:
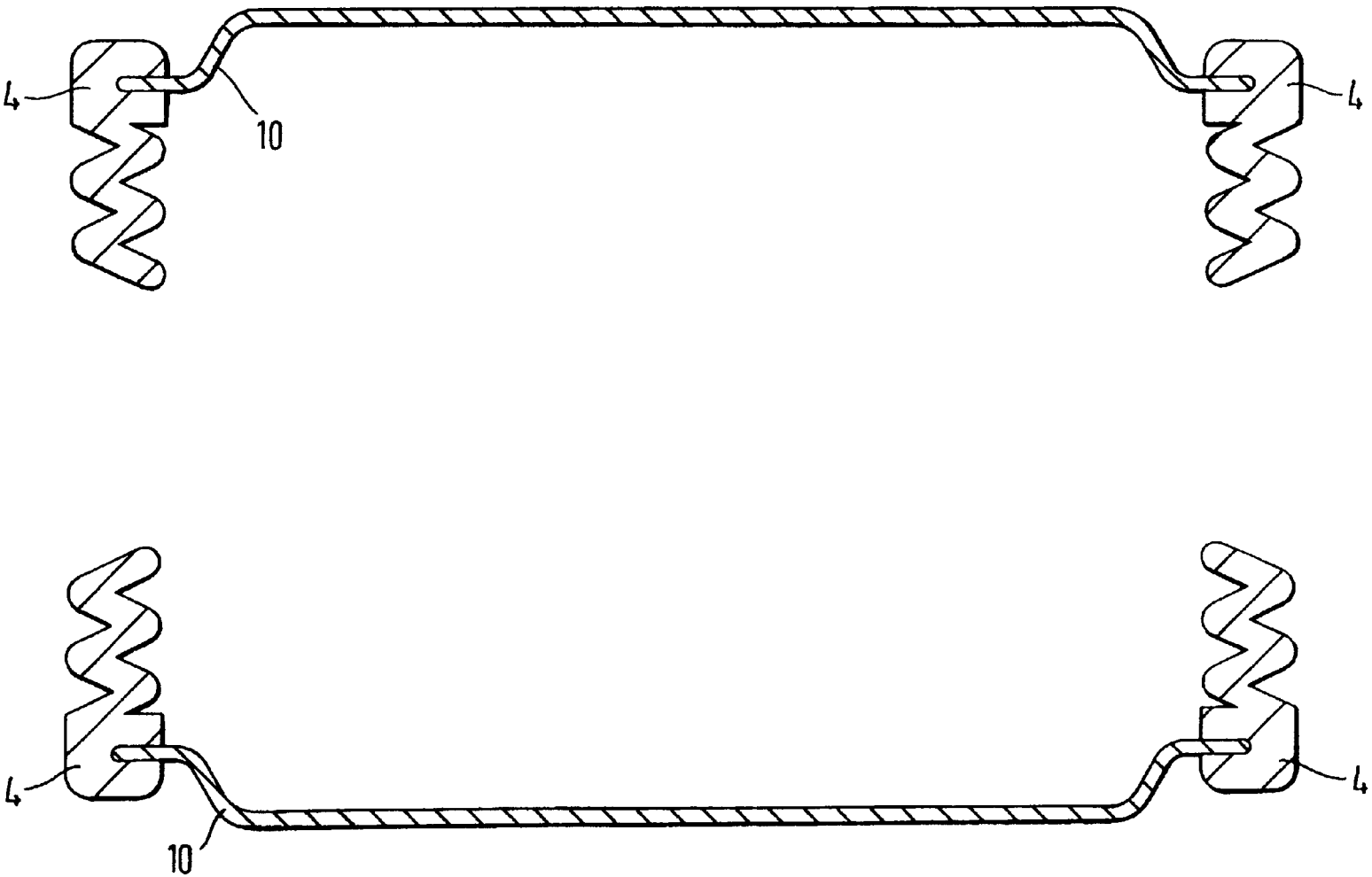
FIG. 6 shows a cross-section through the shell of FIG. 1 taken along the plane A–A' and showing the sealing device secured to a flange of the shell.
Figure 7:
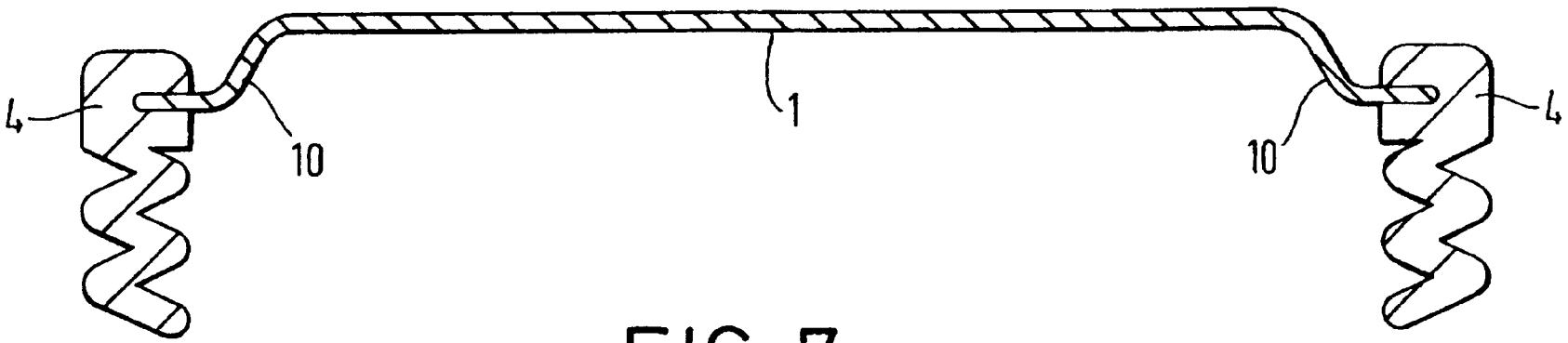
FIG. 7 shows a cross-section through the shell of FIG. 1 along the line C–C' with the sealing device secured to the flange.
Figure 8:
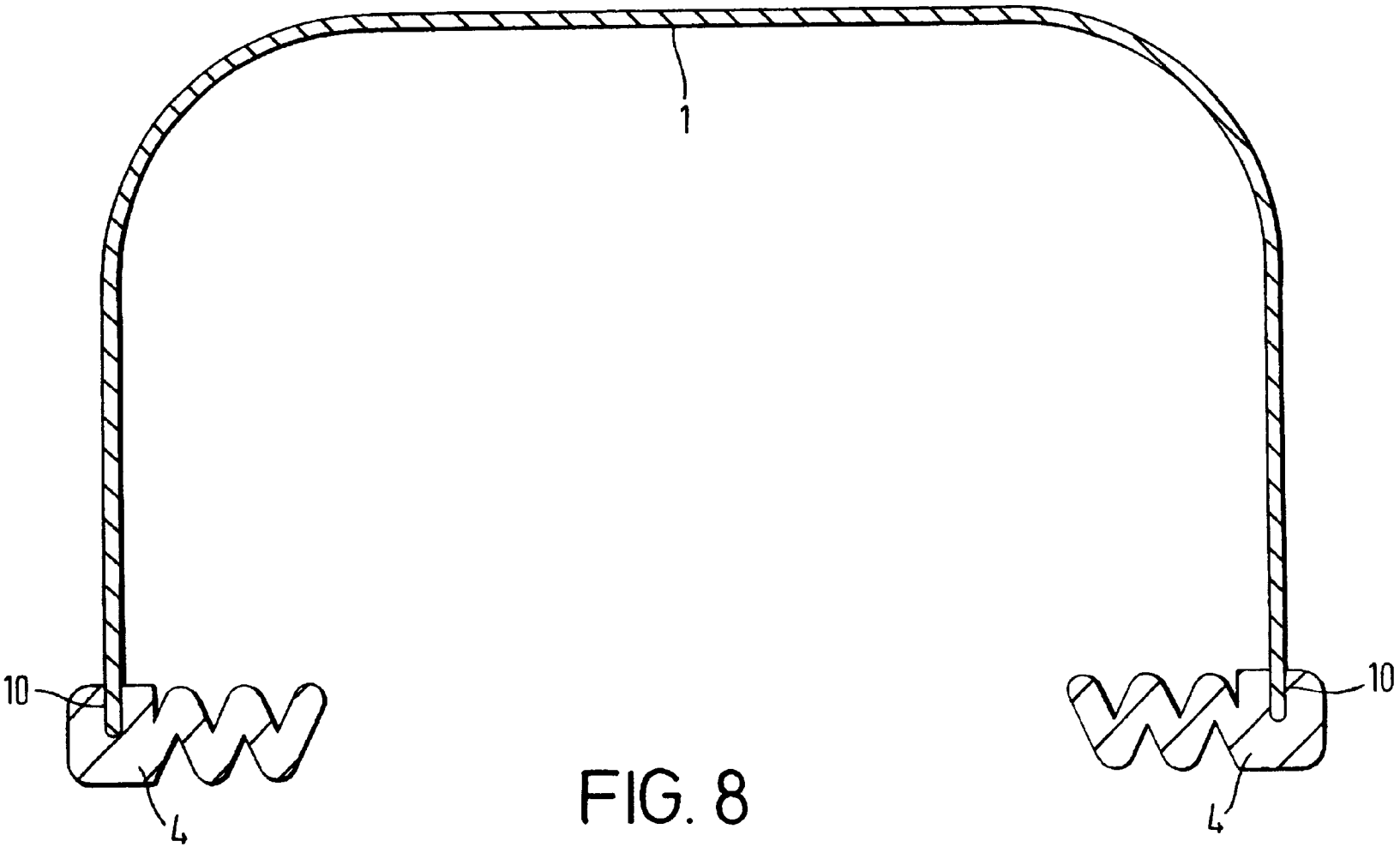
FIG. 8 shows a cross-section through the shell, taken along the line D–D' again with the sealing device secured to the flange.

Turning to FIG. 5, a preferred embodiment of the shell has a hook type fastener strip 111 having upwardly-disposed hooks 112 secured to the concave surface of the flange region. The hooks 112 engage in the foam material of the sealing device to provide a removable but secure attachment therebetween.

It will be seen by reference to FIGS. 1, and 6–8 that the sealing device is directed inwardly along second and third portions of the shell which run, in use, parallel to the height of the patient, the sealing device 4 is directed downwardly in first and fourth portions of the shell which are respectively proximate the chest and abdomen of the patient in use, and which run generally across the patient. In the side regions of the shell, which in use engage the side of the rib cage and the side of the abdomen, and which run in use vertically between the first and second, first and third, fourth and second, fourth and third portions, the sealing member is directed inwardly towards the patient. The construction of the sealing device affords a large amount of flexibility and a smooth transition from one sealing direction to another—for example between the, in use, generally-horizontal chest engaging part of the seal and the generally-vertical side-of-chest engaging part of the seal. The ability of the seal to conform to the edge of the shell, at the shell-edge end of the seal means that there is little likelihood of the seal tearing at that end. Due to the selection of a resilient foam material, the pleating of the intermediate part of the sealing device, the sealing device also forms a good seal between the shell and the body of a patient with little or no tendency either to tear or to cause high pressure regions on the patient's body which would give rise to discomfort or the need for increased nursing supervision.

As mentioned above, in the embodiment shown in FIG. 1, the sealing region 42 lies at one extreme of the sealing device 4. It would however be possible for the sealing region 42 to be continued on into a flat region or other region if this was advantageous.

In plan, the sealing device is ring-like and is continuous. The continuous ring may be achieved by cementing together the end portions of a strip of sealing material while the sealing device may be manufactured in the ring like form.

It has been found that use of the hook-type sealing device allows for ready removal of the sealing device from the shell. This permits easy disposal of the sealing device if so desired. It will be understood by those skilled in the art that where the ventilator is used to treat infectious patients, it may be desirable for hygienic reasons to use a new sealing device for each patient. Provision of disposable sealing devices is further advantageous in that there is no need to clean or sterilise the sealing device when the ventilator is moved from one patient to another. It would alternatively be possible to remove the sealing device for cleaning or sterilisation and to apply a previously-cleaned or sterilised sealing device to a ventilator shell.

The material of the sealing device 4 may be of natural or artificial rubber or plastics material, or any other material which provides the desired flexibility and resilience although the sealing device is shown secured to a shell having an outwardly-directed flange region, it would of course be possible to provide a suitable securing region for securing the sealing device to other types of shell. Because the sealing performance is determined in the main by the sealing device 4, the need for flexibility in the shell itself is greatly reduced, or eliminated which means that the material of the shell may be selected from a wider range. Moreover, the fact that the sealing device conforms to the shape of the patient's body means that the fitting straps (not shown) around the back of the patient's body are not transmitting reaction forces against the resilience of the shell material to the patient's body and thus causing discomfort. The shell is advantageously of polycarbonate material, but other materials are possible.

What is claimed is:

1. A cuirass ventilator having a shell member and a seal, the shell member having a front portion and a rear portion, each of said front and rear portions having a top edge and two side edges, the shell member further having two opposing side portions, each of said side portions having a respective edge, the edges of the front, rear and side portions together forming a peripheral edge running continuously around said shell member, and the seal depending from said peripheral edge and running around said peripheral edge wherein said seal has a sealing region, a body portion and a resilient pleated region, a resilient pleated region being intermediate the sealing region and the body portion, and wherein the resilient pleated region is for urging the sealing region into sealing engagement when disposed on a patient's body.

2. The cuirass ventilator of claim 1, wherein the pleated region comprises a plurality of pleat portions connected serially at fold regions, said pleat portions comprising a first end portion and a second end portion, the first end portion being contiguous with said body portion at a first end fold region and the second end portion being opposite said first end portion and contiguous with said sealing region at a second end fold region.

3. The cuirass ventilator of claim 2, wherein the seal is so secured to the shell member as to be inwardly directed with respect to the opposing side portions and to be downwardly directed with respect to the top edges of the front and rear edge portions.

4. The cuirass ventilator of claim 3, wherein said shell further comprises respective transition portions which extend contiguously between each side edge of the front portion and the edge of the respective side portion.

5. The cuirass ventilator of claim 4, wherein in said transition portions, the seal is shaped for resilient conformability with a body of a patient when so disposed.

6. The cuirass ventilator of claim 2, wherein said plurality of pleat portions comprises four pleat portions.

7. The cuirass ventilator of claim 1, wherein the shell member is provided with a peripheral flange region and the securing region of the seal comprises the walls of a counterpart slot for receiving therein the flange region.

8. The cuirass ventilator of claim 7, wherein the peripheral flange region includes a securing lip for retaining the seal thereon.

9. The cuirass ventilator of claim 1, wherein there is provided releasable fastener for securing said seal to said shell.

10. The cuirass ventilator of claim 9, wherein the shell member is provided with a peripheral flange region and said peripheral flange region has a hook securing device for said seal.

* * * * *